US008025537B2

(12) United States Patent
Craig

(10) Patent No.: US 8,025,537 B2
(45) Date of Patent: Sep. 27, 2011

(54) ELECTRICALLY CONDUCTIVE COMPONENT SUITED FOR USE IN ACCESS CONTROL DEVICES

(75) Inventor: Clark Edgar Craig, Winston-Salem, NC (US)

(73) Assignee: Kaba Ilco Corp., Winston-Salem, NC (US)

( * ) Notice: Subject to any disclaimer, the term of this patent is extended or adjusted under 35 U.S.C. 154(b) by 1062 days.

(21) Appl. No.: 11/632,468

(22) PCT Filed: Jun. 28, 2005

(86) PCT No.: PCT/CA2005/001015

§ 371 (c)(1),
(2), (4) Date: Aug. 30, 2007

(87) PCT Pub. No.: WO2006/005157

PCT Pub. Date: Jan. 19, 2006

(65) Prior Publication Data

US 2008/0132100 A1 Jun. 5, 2008

Related U.S. Application Data

(63) Continuation of application No. PCT/CA2005/001015, filed on Jun. 28, 2005.

(60) Provisional application No. 60/587,863, filed on Jul. 15, 2004.

(51) Int. Cl.
*H01R 13/24* (2006.01)

(52) U.S. Cl. ..... 439/700; 439/45; 70/277

(58) Field of Classification Search ..... 439/700, 439/45–46; 70/277
See application file for complete search history.

(56) References Cited

U.S. PATENT DOCUMENTS

| | | | | |
|---|---|---|---|---|
| 4,967,305 | A | 10/1990 | Murrer et al. | |
| 5,033,282 | A | 7/1991 | Gartner et al. | |
| 5,380,211 | A * | 1/1995 | Kawaguchi et al. | 439/74 |
| 5,458,509 | A * | 10/1995 | Hiraoka et al. | 439/700 |
| 5,955,888 | A * | 9/1999 | Frederickson et al. | 324/750.25 |
| 5,960,656 | A * | 10/1999 | Yao | 70/472 |
| 6,026,665 | A * | 2/2000 | Raybary | 70/214 |
| 6,368,451 | B1 * | 4/2002 | Goulette et al. | 174/152 R |
| 6,491,551 | B1 | 12/2002 | Julian et al. | |
| 6,506,082 | B1 * | 1/2003 | Meek et al. | 439/700 |
| 6,640,594 | B1 * | 11/2003 | Yao | 70/277 |
| 7,069,755 | B2 * | 7/2006 | Lies et al. | 70/278.2 |
| 7,154,286 | B1 * | 12/2006 | Marx et al. | 324/755.05 |

FOREIGN PATENT DOCUMENTS

| | | |
|---|---|---|
| DE | 42 10 894 A1 | 10/1993 |
| DE | 102 06 733 A1 | 8/2002 |

* cited by examiner

*Primary Examiner* — Truc Nguyen
(74) *Attorney, Agent, or Firm* — Miles & Stockbridge P.C.; David R. Schaffer, Esq.

(57) ABSTRACT

An access control device (10) has an electronic/electric control unit (19) fed with electrical current via an electrically conductive fastener (28), such as the ones that also function to clamp the outdoor and indoor housings (15, 17) of the device (10) together against the opposed sides of a door (12) or the like.

21 Claims, 4 Drawing Sheets

ELECTRICALLY CONDUCTIVE COMPONENT SUITED FOR USE IN ACCESS CONTROL DEVICES

RELATED APPLICATIONS

This is a continuation of International Patent Application No. PCT/CA2005/001015 filed Jun. 28, 2005, which claims benefit of U.S. Provisional Application No. 60/587,863 filed Jul. 15, 2004.

BACKGROUND OF THE INVENTION

1. Field of the Invention

The present invention generally relates to electrical current transmission and, more particularly, to a new way of transferring electrical current from one component to another.

2. Description of the Prior Art

Electro-mechanical and electronic access control devices, commonly referred to as "locks" need a source of power to operate the electronics that decode inputs caused by persons attempting access and also to provide motive force for initiating unlocking. The prior art includes various methods of providing power internal to the access control device, such as primary and secondary batteries, dynamo generators, piezoelectric generators and solar cells. External sources of power are also employed, such as voltage stepped down from 120 VAC household current. For external power, the prior art includes wiring directly to the access control device or wiring to the strike area in the door frame then transferring the power from the strike through the latch bolt and then to the lock electronics.

In the prior art, power has been transferred from one side of the door to the other through a cable. Cables are typically difficult to install and susceptible to damage. Cables also require an additional assembly step for the installer.

SUMMARY OF THE INVENTION

It is therefore an aim of the present invention to provide a new way of electrically connecting two components without using traditional cable or wires.

It is a further aim of the present invention to eliminate the need to resort to power transmission cables, to increase lock durability and ease of installation by making power connection transparent to the lock installer.

Therefore, in accordance with the present invention, there is provided an electrical connection comprising first and second conductive components provided on alternate sides of a structural member, a mechanical fastener extending through said structural member and electrically connecting said first and second conductive components.

In accordance with a further general aspect of the present invention, there is provided an access control device comprising an indoor housing component and outdoor housing component respectively mounted on inner and outer sides of a mounting structure, a mechanical fastener extending thicknesswise through the mounting structure, the mechanical fastener defining an axially extending current path through the mounting structure to electrically connect a source of current located on an inner side of the mounting structure to a control unit located in said outdoor housing component.

In accordance with a further general aspect of the present invention, there is provided an electronic/electric device comprising a mechanical fastener extending thicknesswise through a wall structure physically separating first and second conductive components, the fastener having a shank defining a current path along a length thereof for transferring current from the first conductive component to the second conductive component through the thickness of the wall structure.

BRIEF DESCRIPTION OF THE DRAWINGS

Reference will now be made to the accompanying drawings, showing by way of illustration a preferred embodiment of the invention, and in which.

DESCRIPTION OF THE PREFERRED EMBODIMENTS

Figure 1:
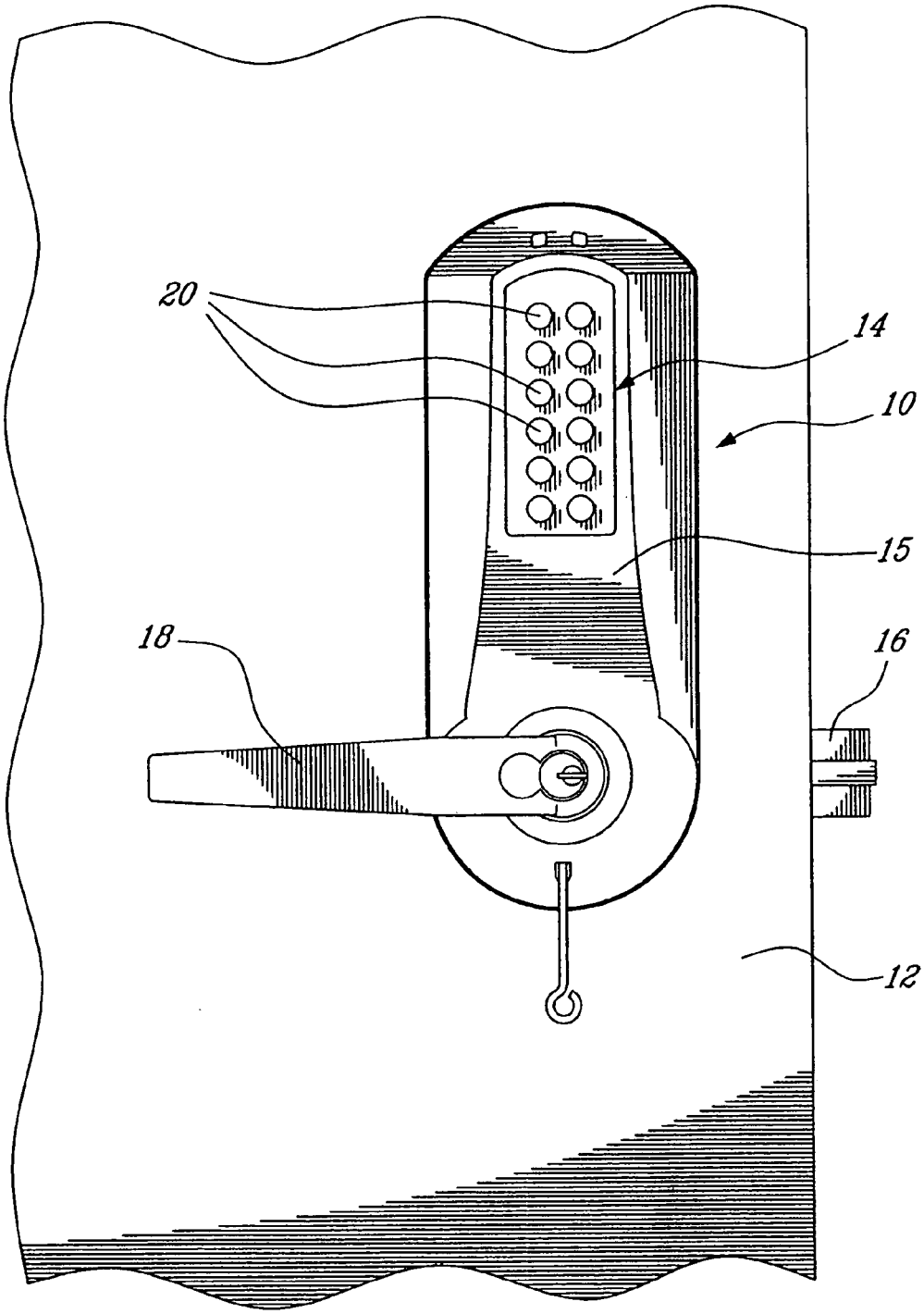
FIG. 1 is a front elevation view of a lock mounted to a door and including an electronic access control device in accordance with an embodiment of the present invention.
Figure 2:
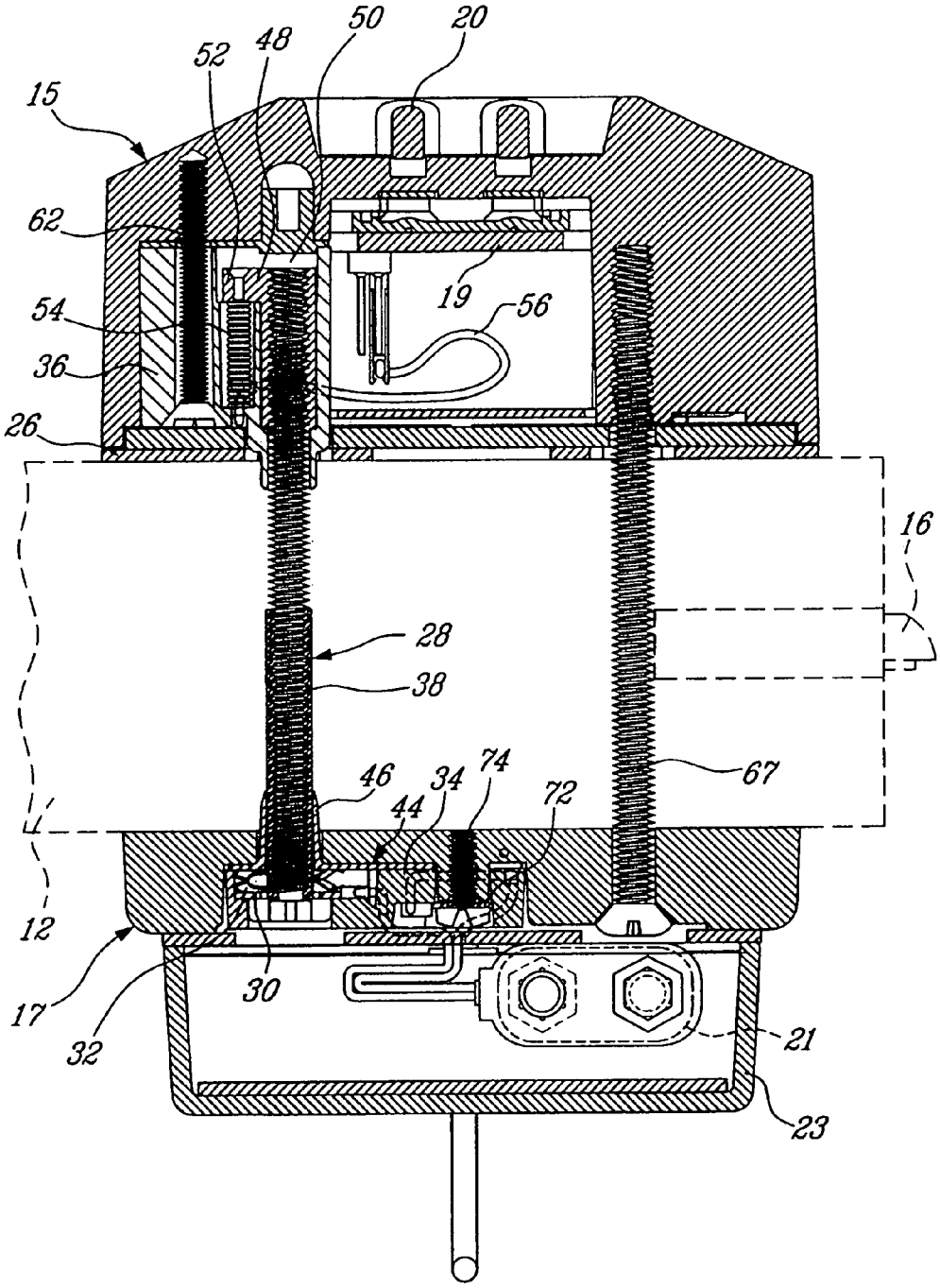
FIG. 2 is a bottom cross-sectional view of the lock shown in FIG. 1.

FIGS. 1 and 2 show a lock 10 mounted to a door 12 for selectively preventing and enabling opening of the door 12. The lock 10 comprises an electronic access control device 14 adapted to control the operation of a latch bolt 16. The term "door" is herein intended to mean any surface upon which an access control device can be mounted.

Figure 3:
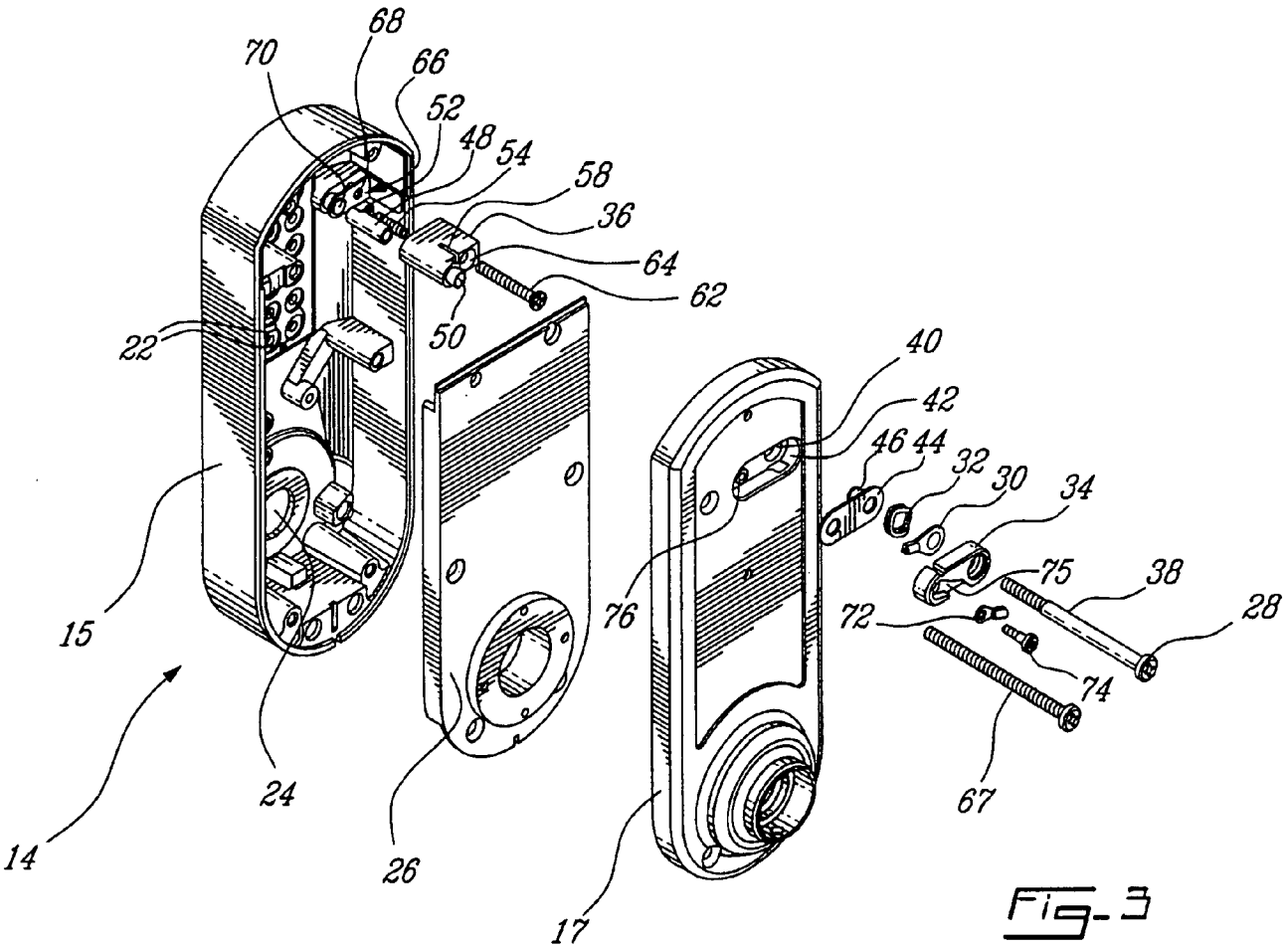
FIG. 3 is an exploded perspective view of the electronic access control device of the lock shown in FIG. 1.

As shown in FIGS. 2 and 3, the access control device 14 has an outdoor housing component 15 and an indoor housing component 17 adapted to be respectively mounted on the outer and inner side of the door 12. The outdoor housing component 15 houses an electronic control unit 19 (FIG. 2) operational for allowing or preventing retraction of latch bolt 16 by manual operation of a handle 18 (FIG. 1). The electronic control unit 19 typically includes a circuit board operatively associated to a number of data entry key buttons 20 (FIGS. 1 and 2) for activation to enter combination and initialization data, as is well known in the art. The entry buttons 20 are provided with contact points to activate corresponding contacts on the circuit board 19 after the buttons 20 have been pressed.

As shown in FIG. 3, the outdoor housing 15 has a front wall defining an array of openings 22 configured and disposed to receive the corresponding data entry buttons 20. A circular opening 24 is also defined at the lower end of the front wall of the outdoor housing component 15 for receiving the drive shaft which is connected to the handle 18 for allowing operation of the latch bolt 16. A back plate 26 is provided for closing the back face of the outdoor housing component 15 while allowing the same to be mounted to the outside surface of the door. The back plate 26 is preferably removably secured to the outdoor housing component 15 by means of mechanical fasteners, such as screws (not shown).

A source of power is provided for powering the electronic control unit. The source of power can, for instance, be provided in the form of battery 21 (FIG. 2) housed in a casing 23 mounted to indoor housing component 17. Alternatively, the source of power could be housed on the indoor surface of the door 12 next to the indoor housing component 17. Other mounting alternatives are contemplated as well. According to an aspect of the present invention, power is transmitted from the battery 21 to the electronic control unit 19 through the thickness of the door 12 via a mechanical fastener, such as one of the bolts used to clamp the outdoor and indoor housing components 15 and 17 together against opposite sides of the door 12.

For instance, in accordance with a preferred embodiment of the present invention, power is supplied from the battery 21 to an electrically conductive bolt 28 through a standard ring lug 30 (electrical crimp lug), which is spring loaded against the underside of the bolt head by a wave spring 32. This advantageously guarantees intimate electrical contact between the bolt head and lug 30. As can be appreciated from FIG. 2, the bolt head and lug 30 can move in and out to compensate for door expansion and contraction. The bolt 28 is insulated by terminal blocks 34 and 36 at both surface interfaces and also separately insulated along its length by an insulating coating or a heat shrink tubing 38. The terminal blocks 34 and 36 are made from an insulating material, such as plastic. The bolt 28 extends through a hole 40 defined in the bottom of a recess 42 defined in the back face of the indoor housing component 17. The inside terminal block 34 is received in the recess 42. An insulator 44 is mounted in the recess prior to the inside terminal block 34 and has a sleeve portion 46 which extends through the hole 40 and which is adapted to receive the bolt 28 to prevent power transmission from the bolt 28 to the indoor housing component 17. The ring lug 30 is received in a corresponding recess (not shown) defined in the inside terminal block 34 in order to insulate the ring lug 30 from its surrounding environment.

The bolt 28 extends through the indoor housing component 17, through the thickness of the door 12 and into the outdoor housing component 15, thereby allowing power to pass from the inner side of the door to the outer side thereof. The bolt 28 is threadably engaged at the leading end thereof (opposite its head) with the inner threads of a threaded contact sleeve 48 received in a corresponding L-shaped hole 50 (FIGS. 1 and 2) defined in the outside terminal block 36. According to a preferred embodiment, the internally threaded sleeve 48 is made from brass. As an added precaution to insure good electrical and mechanical connection between the outside bolt end and the sleeve 48, the sleeve 48 is threaded with a special thread form that provides more intimate electrical contact and resists loosening. For instance, known self-locking threads could be used. Alternatively, the sleeve 48 could be slightly deformed to provide the desired thread locking feature. Other types of tensioners are contemplated as well.

Figure 4:
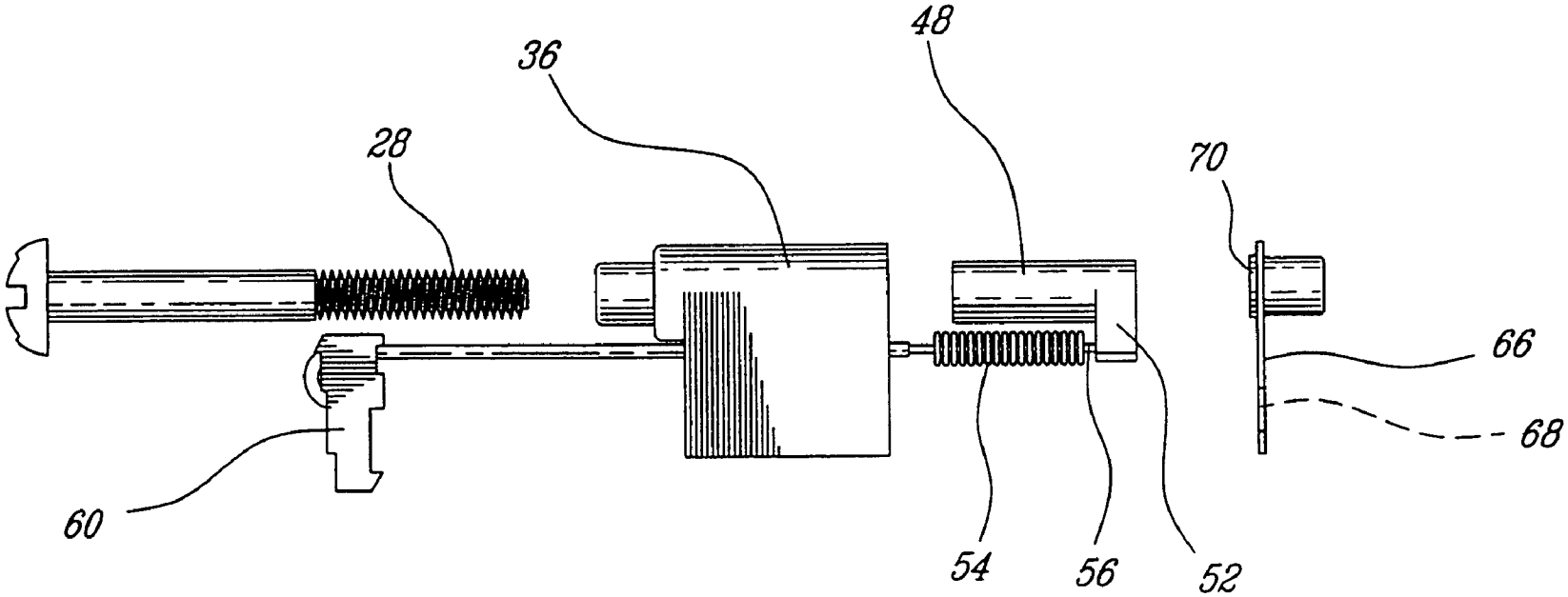
FIG. 4 is an exploded plan view of the outside power transmission components of the electronic access control device.

The contact sleeve 48 has an integral foot portion 52 projecting at right angles from one end thereof. The sleeve 48 and the foot portion 52 have an L-shape configuration. A compression spring 54 extends between the foot portion 52 and the outside terminal block 36 about a wire 56 (FIG. 4) having a first end in electrical contact with the foot portion 52. The first end of the wire 56 can be soldered to the foot portion 52 or otherwise connected thereto. Alternatively, the compression spring 54 could act on a washer provided at the first end of the wire 56 to maintain the same in electrical contact with the foot portion 52 of the sleeve 48. However, the main role of the compression spring 54 is to bias the female threads of the sleeve 48 against the male bolt threads of bolts 28 within the insulated terminal block 36. The wave spring 32 also cooperates with the compression spring 54 to maintain the bolt 28 under tension in both directions in order to further force the contact threads together.

The compression spring 54 in the outside terminal block 36 and wave spring 32 in the inside terminal block 34 act as tensioners to keep the bolt 28 under constant tension to prevent loss of conduction due to vibration, mechanical shock or thermal/mechanical changes in the mounting surfaces. Thus, the bolt 28 is in constant tension, being biased away from both mounting surfaces of the door 12 to insure good electrical contact even as mounting thickness changes with fluctuations in temperature, humidity, or due to other factors. This constitutes a significant advantage of the preferred embodiment of the present invention.

The wire 56 extends through a slotted passage 58 defined in the outside terminal block 36 and the second end 60 (FIG. 2) thereof is connected to one pin of the electronic control unit 19, thereby allowing power to be transferred from the contact sleeve 48 to the lateral foot portion 52 thereof, the wire 56 and then to the control unit 19.

Once assembled, the outside terminal block 36, the contact sleeve 48 and the compression spring 54 are mounted to the outdoor housing component 15 as a single unit by means of a screw 62 extending through a hole 64 defined in the outside terminal block 36. An outside insulator plate 66 is interposed between the outdoor housing component 15 and the foot portion 52 of the contact sleeve 48 to prevent electrical transmission therebetween. A hole 68, is defined in the insulator plate 66 for allowing the screw 62 to be threadably engaged in a corresponding hole defined in the outdoor housing component 15. A locating peg 70 can also be provided on the insulator plate 66 to cooperate with the outside terminal block 36 to facilitate the installation procedure.

As shown in FIG. 2, a gap is provided between cover plate 66 and the spring-loaded threaded sleeve 48 to accommodate movement of the sleeve 48 in order to keep tension on the threads of bolt 28.

The ring lug 30, the bolt 28, the contact sleeve 48, the foot portion 52, and the wire 56 provide one "leg" of the power to the electronic control unit. In the preferred embodiment, the other power leg is provided by the remaining bolts used to fasten the lock 10 to the door 12, one of which is illustrated at 67 in FIG. 2, since these typically pass through from one side to the other to fasten the indoor and outdoor housing components 15 and 17 together. Also in the preferred embodiment, the bolt 28 provides the positive battery voltage and the remaining bolts provide the negative voltage. However, it is understood that the bolt 28 could be connected to the negative side of the battery and the other bolts to the positive side thereof.

According to the preferred embodiment of the present invention, the negative side of the battery 21 is grounded to the electrically conductive indoor housing 17 via a second ring lug 72 engaged with a screw 74 threadably engaged with a threaded hole 76 defined in the bottom of the recess 42 of the conductive indoor housing component 17. The ring lug 72 is received in a corresponding recess 75 defined in the insulating terminal block 34. The indoor housing 17 in turn communicates with the conductive through bolts 67. The through bolts 67 in turn conduct to the outdoor conductive housing component 15. The electronic control circuit is grounded to the outdoor housing component 15 and receives the negative battery voltage from that ground. Where non-conductive housings are used, additional internal wiring may be needed to supplement the positive or negative legs.

Alternatively, a second power bolt 28 could be used to provide the negative battery power and a wire could connect it directly to the electronic control unit.

It is understood that the device 14 could be mounted on a doorframe or a wall instead of on door 12. Also, it is understood that the present invention could also be used in applications where data are communicated through bolt 28 independently or in concert with power. Furthermore, it will be readily apparent for a person skilled in the art, that a plurality of such bolts could be used within a single device. Also, it is understood that the electrically conductive bolt could be used for the sole purpose of conducting current without performing other mechanical or physical interconnection functions.

Although the present invention has been described in the context of a door lock, it is understood that it could also be used for powering of access control auxiliary devices such as electric strikes, turnstiles, gates, and ancillary surveillance and data input devices such as cameras, keypads, RFI and biometric scanning devices. In fact some of the principles of the present application could be applied to a wide variety of electric/electronic devices and are not limited to control access systems. Also, it is understood that the present invention is not limited to fixed applications but could be used in mobile applications as well. Finally, the invention can be applied to both internally powered and externally powered devices or those powered by a combination of internal and external sources.

The invention claimed is:

1. An electrical connection comprising first and second conductive components provided on alternate sides of a structural member, a mechanical fastener extending through said structural member and electrically connecting said first and second conductive components, said second conductive component being received in a second non-conductive terminal block, the mechanical fastener having a leading end extending into said second non-conductive terminal block for engagement with said second conductive component, and biasing means for biasing the mechanical fastener in intimate electrical contact with the first and second conductive components, the biasing means being provided within said second non-conductive terminal block to spring-load said second conductive component.

2. An electrical connection as defined in claim 1, wherein said mechanical fastener has a head and a shank defining an axially extending current path along a length thereof and electrically bridging the first and second conductive components, the fastener having a first end portion electrically connected to the first conductive component and a second end portion electrically connected to the second conductive component, the current travelling from the first conductive component, longitudinally through the shank, and then to the second conductive component, and wherein the biasing means act in a longitudinal direction relative to the fastener.

3. The electrical connection defined in claim 2, wherein the fastener is threadably engaged at said second end portion thereof with said second conductive component, the current being transmitted from said fastener to said second conductive component through thread contact, and wherein the biasing member urges the fastener and the second conductive component away from one another to provide intimate electrical thread contact therebetween.

4. The electrical connection defined in claim 1, wherein the fastener is biased away from at least one of said alternate sides of the structural member by the biasing means in order to insure good electrical contact even as the structural member thickness changes with fluctuations in temperature, humidity, or due to other factors.

5. The electrical connection defined in claim 4, wherein said biasing means consists solely of a collective residual resilience of the first and second conductive components and the structural member.

6. The electrical connection defined in claim 4, wherein said biasing means include first and second biasing members acting in opposed axial directions at opposed ends of the fastener for biasing the fastener away from both said alternate sides of the structural member.

7. The electrical connection defined in claim 1, wherein the biasing means include a tensioner maintaining the fastener under tension to ensure continuous electrical contact between the source of current and the conductive component irrespectively of thickness variations of the structural member over time.

8. The electrical connection defined in claim 1, wherein the biasing means include a biasing member provided between a second side of the structural member and the second conductive component.

9. The electrical connection defined in claim 1, further comprising first and second housing components, the fastener being also used to mount the housing components to said alternate sides of the structural member.

10. The electrical connection defined in claim 7, wherein said fastener is threadably engaged with said second conductive component, and wherein said tensioner includes self-locking threads.

11. The electrical connection defined in claim 1, wherein said non-conductive terminal block, said fastener and said second conductive component are mounted as a unit to a second housing component which is, in turn, mounted to the structural member through said fastener.

12. The electrical connection defined in claim 11, wherein said fastener extends through a first housing component mounted on a first side of the structural member opposite said second housing component, said fastener having a head, said head being received in a first non-conductive terminal bock mounted to said first housing component.

13. The electrical connection defined in claim 12, wherein said first conductive component comprises a source of current connected to said fastener through a lug spring-loaded against an undersurface of the head of the fastener.

14. The electrical connection defined in claim 13, wherein the source of power has a positive side and a negative side, and wherein additional fasteners extend through the structural member to clamp said first and second housing components on the alternate sides thereof, and wherein said positive and negative sides are connected to said mechanical fastener and at least one of said additional fasteners, thereby permitting current to circulate from one side of the structural member to the opposed sides thereof without using any conventional wire or cable therebetween.

15. An access control device comprising an indoor housing component and an outdoor housing component respectively mounted on inner and outer sides of a mounting structure, a mechanical fastener extending thicknesswise through the mounting structure, the mechanical fastener defining an axially extending current path through the mounting structure to electrically connect a source of current located on an inner side of the mounting structure to a control unit located in said outdoor housing component, wherein the fastener is directly or indirectly biased away from at least one of the inner and outer sides of the mounting structure by biasing means in order to insure good electrical contact even as the mounting structure thickness changes with fluctuations in temperature, humidity, or due to other factors.

16. The access control device defined in claim 15, wherein the mechanical fastener also mechanically connects the indoor and outdoor housing components together.

17. The access control device as defined in claim 15, wherein said biasing means include first and second biasing members acting in opposed axial directions at opposed ends of the fastener for biasing the fastener away from both said inner and outer sides of the mounting structure.

18. The access control device as defined in claim 15, wherein the biasing means include a tensioner maintaining the fastener under tension to ensure continuous electrical contact between the source of current and the conductive component irrespectively of thickness variations of said mounting structure over time.

19. An access control device comprising a source of current on a first side of a wall structure, a control unit located on a second opposite side of the wall structure, a mechanical fastener extending thicknesswise through a wall structure physically separating first and second conductive components, the mechanical fastener having a shank defining a current path along a length thereof for transferring current from the source of current to the control unit through the thickness of the wall structure, and wherein the mechanical fastener is maintained under tension by a biasing means.

20. The access control device defined in claim 19, wherein the fastener is directly or indirectly biased away from at least one of the first and second sides of the wall structure by the biasing member in order to insure good electrical contact even as the mounting structure thickness changes with fluctuations in temperature, humidity, or due to other factors.

21. The access control device defined in claim 20, wherein said biasing member include first and second biasing members acting in opposed axial directions at opposed ends of the fastener for biasing the fastener away from both said first and second sides of the wall structure.

* * * * *

UNITED STATES PATENT AND TRADEMARK OFFICE

CERTIFICATE OF CORRECTION

PATENT NO. : 8,025,537 B2
APPLICATION NO. : 11/632468
DATED : September 27, 2011
INVENTOR(S) : Clark Edgar Craig It is certified that error appears in the above-identified patent and that said Letters Patent is hereby corrected as shown below:

In the Claims:

Column 6 – Line 27, Claim 12: replace “bock” with --block--.

Signed and Sealed this
Twenty-ninth Day of November, 2011

David J. Kappos

David J. Kappos
*Director of the United States Patent and Trademark Office*